United States Patent [19]

Leuzzi

[11] 4,239,050

[45] Dec. 16, 1980

[54] HAIR CURLER

[76] Inventor: Ennio Leuzzi, No. 4, Via Monteverde, Rome, Italy

[21] Appl. No.: 7,745

[22] Filed: Jan. 30, 1979

[30] Foreign Application Priority Data

Feb. 7, 1978 [IT] Italy ..... 35596/78[U]

[51] Int. Cl.[3] ..... A45D 2/00
[52] U.S. Cl. ..... 132/40
[58] Field of Search ..... 132/40, 42, 48

[56] References Cited

U.S. PATENT DOCUMENTS

| | | | |
|---|---|---|---|
| 23,016 | 1/1894 | Schutz | 132/42 R |
| 1,526,480 | 2/1925 | Krieg | 132/40 X |
| 1,724,249 | 8/1929 | Baldwin | 132/40 |
| 4,141,371 | 2/1979 | Gangnath | 132/40 |

*Primary Examiner*—G. E. McNeill
*Attorney, Agent, or Firm*—Beveridge, DeGrandi, Kline & Lunsford

[57] ABSTRACT

A hair curler comprising a flattened parallelepiped shaped body having convexities on the wide faces and concavities on the narrow faces and means for hooking a rubber band arranged for fastening a lock of hair wound on the hair curler.

8 Claims, 8 Drawing Figures

HAIR CURLER

This invention relates to an improved hair curler which may be manufactured in a variety of materials and which embodies an improved system for the fastening of a lock of hair.

As it is known, the hair curlers presently available on the market for hair curling have a cylindrical shape, and therefore the winding thereon of a lock of hair leaves the hairs in a round-looped or spiral form.

The object of this invention is to provide an improved hair curler comprising a flattened parallelepiped shape, with convexities on the large faces and concavities on the narrow faces, and further provided with means for hooking a rubber band provided for fixing into position a lock of hair wound on the hair curler.

With the hair curler according to this invention, there is obtained a different shaping of the winding of hairs on the hair curler itself which allows to obtain a more gauzy aspect of the hairs when they are relased from the hair curler with a better aesthetical effect.

Advantageously, in its central part, the hair curler comprises an array of holes which permit a better distribution of the hair treatment liquids.

This invention will now be better disclosed with reference to the figures of the enclosed drawing, wherein.

With reference to the drawings and in particular to FIGS. 1 to 4, it can be noted that the hair curler according to the invention comprises a generally parallelepiped body 1, with two ends 3, 4 which define an area with a concavity, symmetrical with respect to the longitudinal axis of the hair curler.

Figure 3:
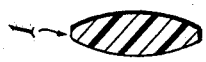
FIG. 3 shows a sectional view along plane III—III of FIG. 1.
Figure 2:
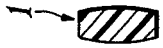
FIG. 2 shows a sectional view along plane II—II of FIG. 1.

Both the lower and upper surfaces of the hair curler are convex in transverse planes as shown in FIGS. 2 and 3.

The body 1 is provided at the end 3, with a protuberance 6 for hooking a rubber band (not shown), the other end of which is fastened in the hole 7.

Figure 1:
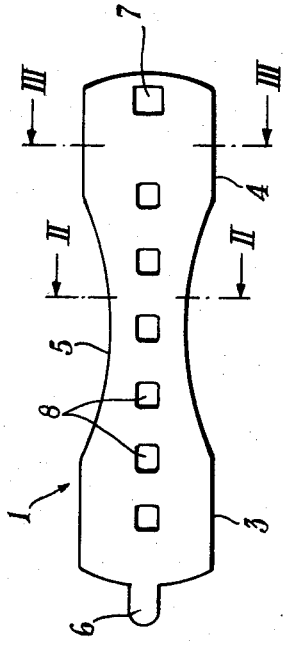
FIG. 1 shows a top plan view of a first embodiment of the hair curler according to the invention.
Figure 4:
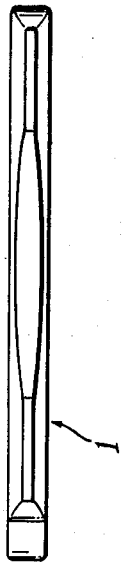
FIG. 4 shows a lateral view of the hair curler of FIG. 1.

As one can see from FIG. 1, the hair curler is provided with a plurality of openings 8 which permit a better distribution of the hair treatment liquid during the hair dressing.

FIGS. 5 to 8 show a second embodiment wherein there is shown a generally parallelepiped body 10, with two ends 12, 13 which define a concave area 14.

The body 10 is provided at one end of a protuberance 15 for hooking a rubber band (not shown), the other end of which is fastened to the T-shaped protuberance 16.

Figure 8:
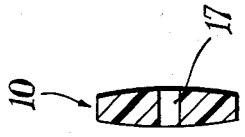
FIG. 8 shows a sectional view along plane VIII—VIII of FIG. 5.
Figure 7:
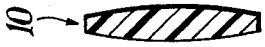
FIG. 7 shows a sectional view along plane VII—VII of FIG. 5.
Figure 5:
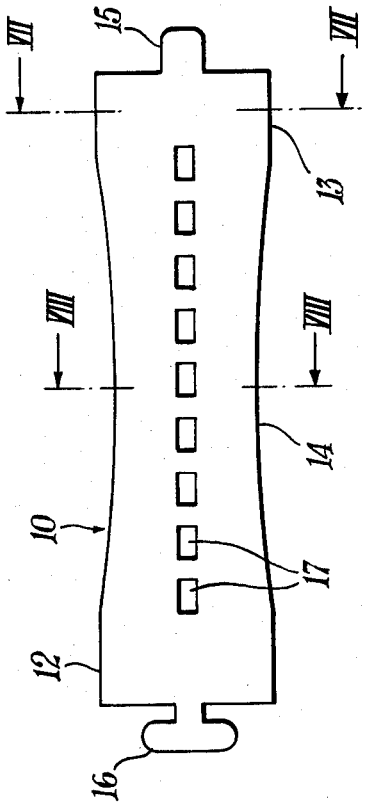
FIG. 5 shows a top plan view of a second embodiment of the hair curler of the invention.
Figure 6:
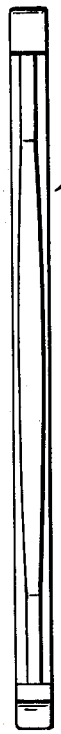
FIG. 6 shows a lateral view of the hair curler of FIG. 5.

FIGS. 7 and 8 show the convexity of the surfaces of the body 10. Also in this embodiment, the body 10 is provided with a plurality of apertures 17 which permit a better distribution of the hair treatment liquid during the hair dressing.

The operation of the above described hair curler is evident to a person skilled in the art: the lock of hair is wound on the area 5 or 14, respectively, and held in this position with a rubber band.

Having thus described the present invention, what is claimed is:

1. A hair curler characterized in that it comprises a flattened parallelepiped shaped body having wide faces which are convex in transverse planes and narrow faces substantial lengths of which are concave with respect to the longitudinal axis of the hair curler, and means at opposite ends of the hair curler for engaging a rubber band arranged for fastening a lock of hair wound on the hair curler.

2. A hair curler according to claim 1, characterized in that said body has a plurality of openings along its longitudinal axis.

3. A hair curler according to either one of claims 1 or 2 characterized in that the means for hooking the rubber band comprise a hole and a protuberance arranged respectively at the ends of the body of the hair curler.

4. A hair curler according to either one of claims 1 or 2 characterized in that the means for hooking the rubber band comprise a pair of protuberance arranged respectively at the ends of the body of the hair curler.

5. A hair curler according to either one of claims 1 or 2 wherein said wide faces are convex with respect to the longitudinal axis of the hair curler.

6. A hair curler comprising a flattened parallelepiped shaped body having longitudinally concave narrow sides and longitudinally convex wide sides, said body having transversely convex upper and lower faces and being provided with a plurality of central openings perforating said upper and lower faces along the longitudinal axis thereof, means being provided at the opposite ends of said body for hooking a rubber band to fasten a lock of hair wound around said curler body.

7. A hair curler as claimed in claim 5, wherein said means for hooking the rubber band consist of a protuberance projecting from one end and a hole provided at the other end of said body.

8. A hair curler as claimed in claim 5, wherein said means for hooking the rubber band consists of two protuberances projecting from the opposite ends of said body.

* * * * *